US007740109B2

(12) United States Patent
Möller et al.

(10) Patent No.: US 7,740,109 B2
(45) Date of Patent: Jun. 22, 2010

(54) METHOD FOR WIRELESS CONTROL OF VEHICLE LIFTING DEVICE

(75) Inventors: Felix Möller, Kehl-Bodersweier (DE); Hans Nussbaum, Kehl-Sundheim (DE)

(73) Assignee: Otto Nussbaum GmbH & Co. KG, Kehl-Bodersweier (DE)

( * ) Notice: Subject to any disclaimer, the term of this patent is extended or adjusted under 35 U.S.C. 154(b) by 459 days.

(21) Appl. No.: 11/747,691

(22) Filed: May 11, 2007

(65) Prior Publication Data

US 2008/0277204 A1 Nov. 13, 2008

(51) Int. Cl.
*B66B 1/28* (2006.01)

(52) U.S. Cl. ..... 187/247; 187/210; 254/45

(58) Field of Classification Search ..... 187/203, 187/207, 210, 213, 224, 226, 227, 233, 247, 187/248, 249, 250, 276, 277, 391, 393, 413; 254/11, 12, 45, 47, 419, 424, 427, 273, 290–292, 254/275; 414/564, 610, 613, 628, 630; 91/171, 91/362; 182/18, 128, 131, 132, 141, 143, 182/144, 147

See application file for complete search history.

(56) References Cited

U.S. PATENT DOCUMENTS 3,968,730 A * 7/1976 Lionet ..... 91/171
4,777,798 A * 10/1988 Jacobson et al. ..... 60/428
6,318,508 B1 * 11/2001 Inoue ..... 187/394
6,634,461 B1 10/2003 Baker
6,964,322 B2 * 11/2005 Green et al. ..... 187/285
7,014,012 B2 3/2006 Baker
7,025,178 B2 * 4/2006 Wengelski et al. ..... 187/277
7,219,770 B2 * 5/2007 Baker ..... 187/247

* cited by examiner

*Primary Examiner*—Jonathan Salata
(74) *Attorney, Agent, or Firm*—Panitch Schwarze Belisario & Nadel LLP

(57) ABSTRACT

A method is provided for controlling a vehicle lifting device, having at least two, preferably moveable, lifting columns (1-4), which are controlled wirelessly. When a switch is activated for raising or lowering the lifting device, a corresponding signal is transmitted wirelessly to the lifting columns (1-4) and additional signals, which are representative of the individual lifting movements, are transmitted to a control device (5). In the case of unacceptably high movement differences between individual lifting columns, the normal operation is stopped. Here, it is essential that for monitoring the wireless signal transmission, the control device (5) exchanges control signals with the lifting columns (1-4) continuously, and the reception of these control signals is monitored at least in one direction.

13 Claims, 4 Drawing Sheets

METHOD FOR WIRELESS CONTROL OF VEHICLE LIFTING DEVICE

BACKGROUND OF THE INVENTION

The invention relates to a method for controlling a vehicle lifting device, wherein at least two—preferably moveable—lifting columns are provided, which are controlled wirelessly, such that when a switch is activated in the sense of raising or lowering the lifting device, a corresponding signal is transmitted wirelessly to the lifting columns, and such that additional signals, which are representative for the individual lifting movements, are transmitted to a control device and for unacceptably high differences in motion among individual lifting columns, the normal operation is stopped.

Such lifting devices with wireless control are known, for example, from U.S. Pat. Nos. 6,634,461 and 7,014,012. Here, each lifting column is provided with its own control device, such that the lifting columns communicate among each other, in order to coordinate the lifting movements.

The sense and purpose of the wireless signal transmission consists in that no electrical cables must be laid between the lifting columns and that the lifting columns can be moved to a different location in the workshop in a very simple manner without detaching them from electrical or hydraulic connections. Therefore, not only is it possible to use the lifting columns equally for passenger cars and also for large trucks, but they can also be moved to the side after use, for example, so that the workshop area becomes free for other tasks.

So that the operation of the lifting columns is not disrupted by external signals, it is already known for security reasons to code the control signals individually. Therefore, only the control signals recognized as correct are accepted at the lifting columns and used for triggering a lifting movement or for stopping the lifting movement.

BRIEF SUMMARY OF THE INVENTION

The present invention is based on the object of further increasing the operating security for lifting devices with wireless signal transmission. In particular, the risk should be excluded that interfering signal transmission leads to an undesired lifting movement of individual lifting columns.

This problem is solved according to the invention in that the control device for monitoring the wireless signal transmission continuously exchanges control signals with the lifting columns and monitors the receipt of these signals at least on one side (i.e., at the control device, at the columns or at both).

In this way there is the advantage that with interfering signal transmission, for example due to noise signals or superposition with other signals or attenuation due to obstacles, it is immediately recognized that the signal transmission is being interfered with. A warning signal can then be triggered and/or the control device terminates the further operation of the lifting device.

Theoretically, it is possible to monitor the reception of the signals transmitted by the control device to the individual lifting columns or the signals transmitted in the opposite direction only on one side. It is more favorable, however, to monitor the signal reception on both sides, that is, the signals transmitted by the lifting columns and also by the control device. In this way, one is guaranteed that the transmitter and receiver of the signals are functioning properly on both sides and that the wireless transmission path is not interfered with.

Control signals are exchanged expediently at a frequency of at least 1 Hz, preferably at least 3 Hz, in particular at least 6 Hz, so that possible interference is recognized immediately. The control signals themselves should lie in a frequency band that cannot be interfered with by external signals. Expediently, the control signals lie in the same frequency band as the control signals, approximately between 2.4 and 2.5 GHz. Also, the regulation and control signals run through the same transmitter and receiver.

In addition, the invention consists in that the mentioned control device is not provided as before on each lifting column, but instead as a single central control device separate from the lifting columns. In this way, the system can be oriented optimally in space in terms of the quality of wireless signal transmission, that is, it can be adapted to the environmental conditions and the vehicle geometry. In addition, by locking up the control device, operation by unauthorized persons can be excluded, which is a significant security advantage. In this case, the control device does not need any operating elements, but instead, first, it receives start or stop signals from one of the lifting columns and forwards these signals to the other lifting columns. Second, it can receive signals from all of the lifting columns, which are representative for the individual lifting movements, in particular, the corresponding lifting position, whereby the control device can also monitor the synchronization of the lifting columns and, if necessary, can adjust an out-of-synchronization lifting column through corresponding signals to this lifting column in the sense of synchronization. In the testing of the individual lifting positions, if unacceptably high differences appear, then the control device can stop the further operation of the lifting columns, such that they are locked in a stable, secure state.

It also lies within the scope of the invention to house control devices as before on the individual lifting columns. In this case, the control devices communicate with each other, that is, the start and stop signals are transmitted by the column where the switch has been activated, forwarded to the other columns, and the columns exchange with each other signals representative for the individual lifting movement, so that all of the lifting columns are kept in synchronization or further operation is stopped for unacceptably high lifting differences.

For realizing the control according to the invention, it is expedient that all of the lifting columns are equipped with measuring elements for determining their lifting position, and the individual lifting positions are transmitted wirelessly to the control device and, if necessary, the control device transmits signals to individual lifting columns in the sense of synchronization and/or stops further operation of the lifting platforms for unacceptably large lifting differences.

So that the lifting device has a redundant safety system, it is recommended that each lifting column is combined with an anti-drop device. In an especially expedient way, this anti-drop device can be realized such that the lifting movement is transferred via a threaded spindle, and this threaded spindle engages with a grip nut, which is set in rotation by lifting movements, and the threaded spindle is set in operative connection with a braking element and is braked when a certain lowering speed is exceeded.

Because this grip nut is rotated proportionally to the lifting course for lifting movements of the spindle, there is still the advantageous possibility that the grip nut at its periphery is in operative connection with an incremental path measurement system. For this purpose, it is provided on its outer periphery with numerous transmitters, magnets, projections, recesses, or the like following each other in the peripheral direction, which are detected and counted by Hall sensors or inductively, so that the rotational path of the grip nut can be determined, and from this path the lifting course of the threaded spindle can be determined.

The signals received by the path measurement system and representing the lifting course can be transmitted wirelessly to the central control device mentioned above, so that the synchronization of all of the lifting columns can be monitored and controlled there.

So that each lifting column is autonomous, it is equipped with a separate power supply, particularly a rechargeable battery and a motor for generating the lifting movement. Preferably, the lifting movement is generated hydraulically by a cylinder/piston assembly, in which the motor drives a corresponding hydraulic pump. Instead, the motor could even generate the lifting movement via a lifting spindle, cables, or in some other way.

Finally, for holding the vehicle, it is recommended that each lifting column be equipped with a wheel fork, which grips from below a wheel of the vehicle to be raised.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
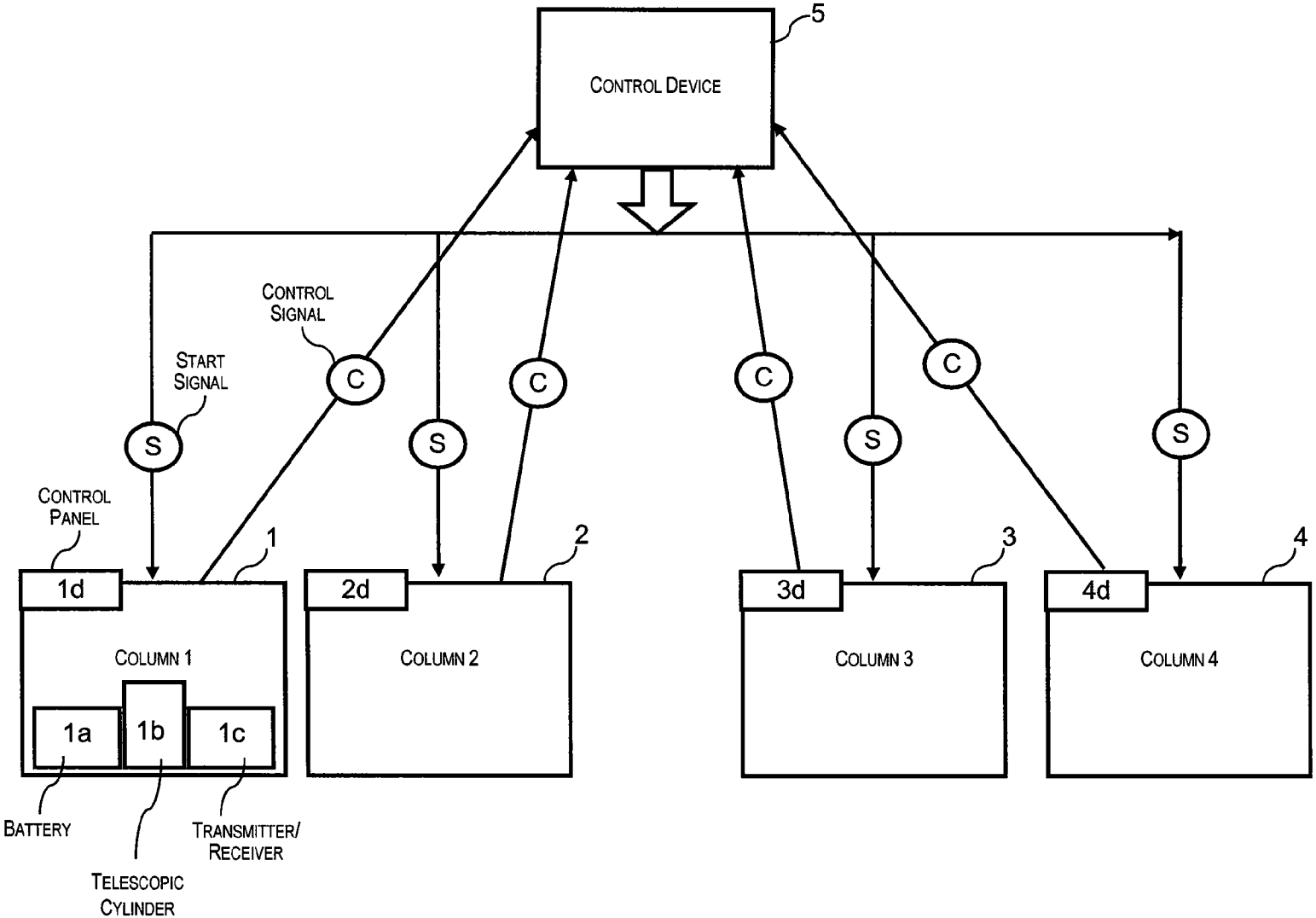
FIG. 1 is a block diagram illustrating the control system according to the invention for four lifting columns.

In FIG. 1 four lifting columns are shown schematically and designated by the reference symbols 1 to 4. In practice, one must imagine the positions of these four lifting columns, such that, for example, the lifting columns 1 and 2 standing opposite each other engage the left and right front wheels of a vehicle and the lifting columns 3 and 4 standing opposite each other correspondingly engage the left and right rear wheels, respectively, of the vehicle. Through their ability to move, they can be moved without a problem to the desired vehicle positions.

Each lifting column has its own energy accumulator, in particular a battery 1*a*, a drive, in particular a telescopic cylinder 1*b*, and a transmitter/receiver unit 1*c*, as shown in the example of the column 1. Therefore, each lifting column is autonomous and requires no external electrical or hydraulic connection.

At least one of the lifting columns, but preferably all of the lifting columns, are equipped on their housing with a control panel 1*d*, 2*d*, 3*d*, and 4*d*, respectively. Therefore, it is possible at each arbitrary column, by activating a switch, to trigger or stop the raising or lowering of all of the lifting columns. For this purpose, the four lifting columns are connected to a common, external control device 5, not via connection lines, but instead wirelessly.

The operation is as follows: if, for example, the switch on the control panel 1*d* on the lifting column 1, is activated in the sense of raising, then the lifting column 1 sends a corresponding control signal in the gigahertz range to the control device 5, as indicated by the arrow c. The control device 5 then sends corresponding start signals to all four lifting columns—corresponding to arrows s. Therefore, all four lifting columns are raised simultaneously. Instead of the mentioned radio signals, obviously other frequencies can also be used.

During this raising, the individual lifting movements of the individual columns are monitored continuously. For this purpose, the lifting columns send their respective current positions to the control device 5. There, if a significant lifting difference among the individual lifting columns is determined, then the control device 5 transmits signals to individual drives of the lifting columns, in the sense that either the trailing lifting column is accelerated or the leading lifting column is delayed, until all of the lifting columns have again reached the same level.

If the lifting difference among individual lifting columns exceeds a predetermined limit value, then the control device 5 interrupts any further lifting motion and holds the four lifting columns in a stable state, so that the supported vehicle cannot move into an unacceptable inclined position.

As an alternative to the signal flow described above, it would also be possible for the individual lifting columns to communicate not only with the control device 5, but instead also with each other, such that one of the lifting columns sets the lifting course as a desired value—that is on the basis of lifting speed and lifting time—for the other lifting columns, and these lifting columns then observe this desired value through their own (i.e., separate) regulating units. In particular, it is thus possible, for example, to place the synchronization control in the individual lifting columns.

It is essential—regardless of how the signal flow proceeds—that for monitoring the wireless signal transmission, the control device continuously exchanges control signals with the lifting columns or, for lifting columns with separate control devices, the control devices exchange control signals with each other continuously and the reception of these control signals is monitored at least on one side. Therefore, the control device(s) can immediately recognize disruptions during the signal exchange and can stop an asynchronous response of individual columns in due time.

So that disruptions in the signal transmission are recognized immediately, the control signals are exchanged as frequently as possible, for example, at a frequency of approximately 10 Hz, each successively in alternating direction. However, it is also within the scope of the invention for the control device and/or the lifting columns to transmit continuous control signals.

Figure 2:
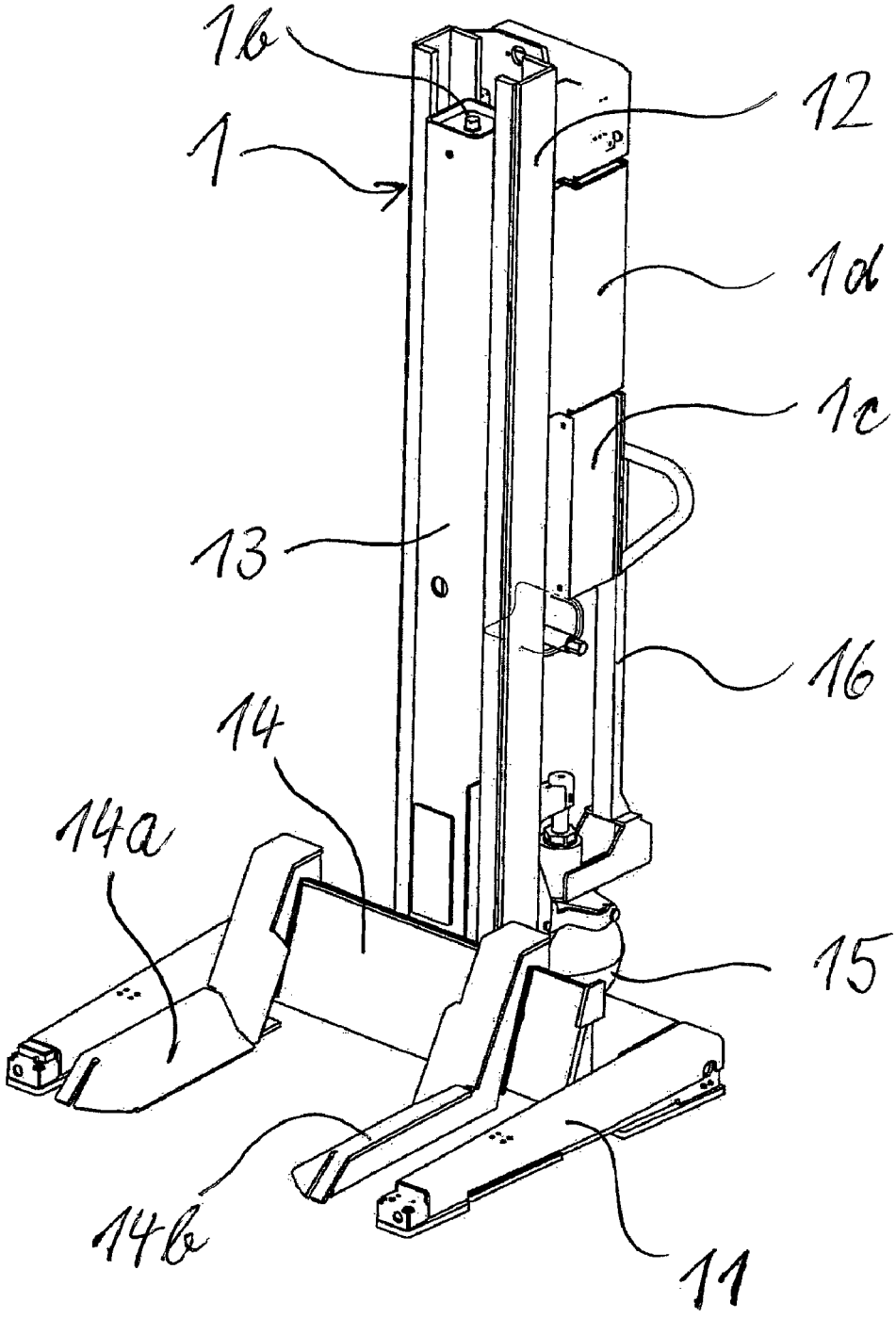
FIG. 2 is a perspective view of a lifting column.

FIG. 2 shows one of the four lifting columns in detail view. One sees that it has a U-shaped basic frame 11, with which it stands on the shop floor. Mounted on this basic frame 11 are vertically upward running guide rails 12, on which a lifting sled 13 is supported so that it can move vertically. The lifting sled 13 carries on its lower end a wheel fork 14 with two projecting fork arms 14*a* and 14*b*, which engage from below a wheel of the vehicle to be raised. So that the fork arms 14*a* and 14*b* can be adapted to different wheel diameters, they are mounted on the lifting sled 13 so that they are horizontally adjustable.

As one sees in FIG. 2 indicated on its side facing away from the wheel fork 14, the lifting column is equipped with an integrated moving gear 15. This moving gear 15 can be moved downwards by a pivoting pole 16, so that the lifting column can be raised locally and can be easily moved to a different position.

In addition, a rechargeable battery (not-shown), an electrically driven hydraulic pump (not shown), and a cylinder/piston assembly 1*b* are installed in the lifting column, so that the lifting sled 13 can perform the desired lifting movements. The control and monitoring are performed via the transmitter/receiver unit 1*c*.

Figure 3:
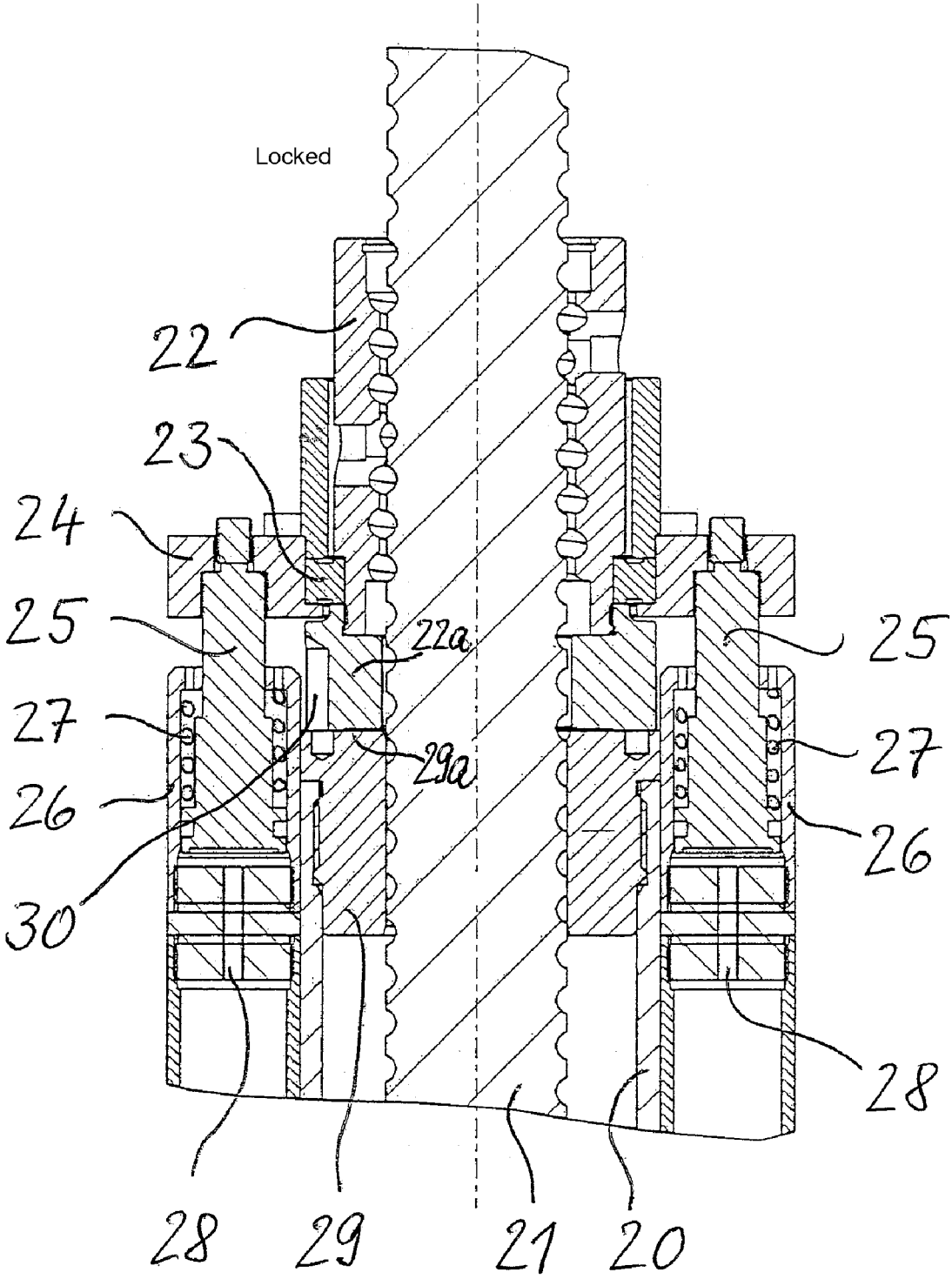
FIG. 3 is an axial sectional view of an anti-drop device in a locked state.
Figure 4:
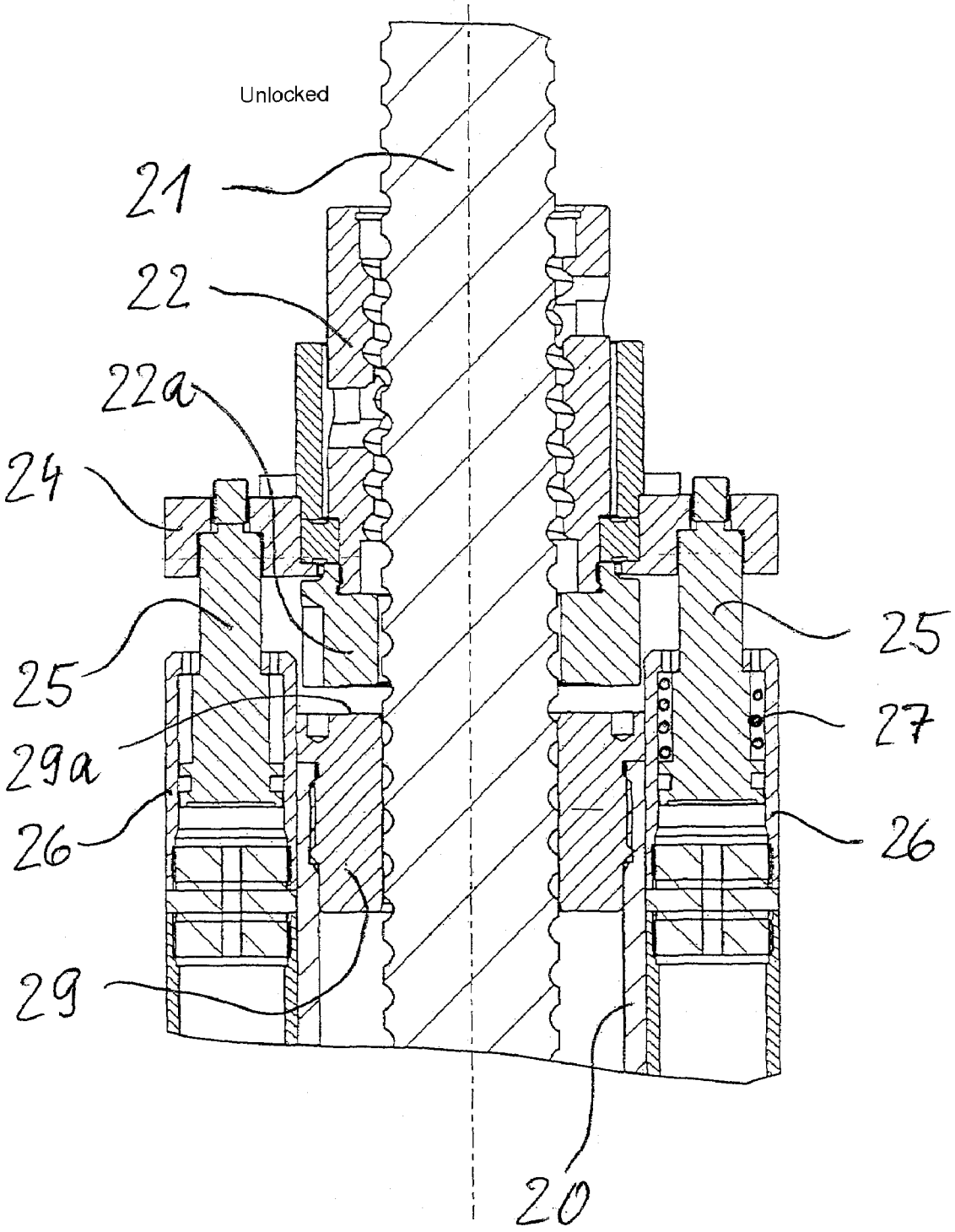
FIG. 4 is an axial sectional view similar to FIG. 3, but with the device in an unlocked state.

FIGS. 3 and 4 show a section of the cylinder/piston assembly at the upper end of the cylinder 20, whose piston rod is embodied as a threaded spindle 21. Its external thread is embodied as a smooth-running movement thread and engages with a grip nut 22 via a plurality of balls arranged in the thread tracks. This grip nut is in turn supported by a ball bearing 23 so that it can rotate in an adjustment ring 24. This adjustment ring is supported on the cylinder 20 via adjustment elements in the form of two lifting pistons 25 so that it can move in the axial direction between the braking position shown in FIG. 3 and the raised position shown in FIG. 4. The lifting pistons 25 are each guided in lifting cylinders 26 and loaded by springs 27 in the direction towards the brake position. In the counter direction, they can each be charged with pressure means via a bore 28 in the base of the lifting cylinder.

The lifting cylinders 26 are mounted rigidly on the outside of the hydraulic cylinder 20. In addition, the cylinder 20 has a radial extending friction surface 29*a* on its stationary guide bushing 29 for the threaded spindle on the outside end. This friction surface acts as a braking element for a similarly radial extending counter friction plate 22*a* fixed to the grip nut 22. The counter friction plate can be formed directly on the grip nut 22 or as a separate component. All that is essential is that the counter friction plate 22*a* be connected substantially rigidly to the grip nut 22, in particular, so that its rotation must follow along with the lifting movements of the threaded spindle 21.

The operation is as follows: if the lifting columns are to be raised, then the hydraulic cylinder 20 is charged with pressure means, so that the piston rod formed as a threaded spindle 21 raises. Here, the grip nut 22 is raised somewhat by the braking element 29 until the counter force of the compression springs 27 prevails over the friction-specific rotational resistance of the grip nut 22. This is the case early on due to the ball-bearing support of the grip nut on the threaded spindle 21 and also on the adjustment ring 24, so that only a minimal, barely visible lifting movement takes place. The further lifting of the threaded spindle 21 is then assumed through pure rotational movement of the grip nut 22.

If a pressure drop occurs in the hydraulic cylinder 20 during this lifting movement, then the threaded spindle 21 is pressed downward by the raised load, and as a result the grip nut 22 is pressed with its counter friction plate 22*a* against the braking element 29. In this way, its ability to rotate is blocked and the threaded spindle 21 is fixed in the position achieved. This process is still accelerated thereby, in that the grip nut 22 wants to rotate further due to its rotational energy in the rotational movement generated during the raising of the lifting device and is then screwed downward in the direction toward the braking element 29, when the threaded spindle greatly reduces its lifting speed.

For lowering the lifting column, the grip nut 22 must first be detached from its restraint with the braking element 29. For this purpose, first the cylinder 20 is charged for a short time with pressure and as soon as the pressure of the grip nut 22, that is, its counter friction plate 22*a*, on the friction surface 29*a* is canceled, the relatively weakly dimensioned lifting cylinders 26 move into action and move the adjustment ring 24 into the position shown in FIG. 4, wherein the distance between the grip nut and the braking element shown there is somewhat greater than in reality. As soon as this state is achieved, the pressure in the hydraulic cylinder 20 is reduced and the lowering movement of the lifting column is initiated. Here, the grip nut 22 rotates in the reverse direction, but is held by the lifting cylinder 26 at a certain safety distance from the braking element.

If a rupture of a hose or the like occur during this lowering movement, then the lifting cylinders 26, which can be connected to the same pressure-means circuit as the hydraulic cylinder 20 or switched separately, become pressure free, so that they are no longer in the position to hold the grip nut in the raised position. Instead, the grip nut is pressed downward against the braking element 29 by the springs 27 and also by the rapidly falling threaded spindle 21, so that further lowering movement is again blocked by self-locking of the grip nut.

Finally, in FIGS. 3 and 4, one sees that the grip nut or the counter friction plate 22*a* locked in rotation with it has, on the outer periphery, a plurality of successive grooves 30, which are detected and counted by sensors when the grip nut rotates. Therefore, the rotational course of the grip nut can be determined and from this the lifting course of the threaded spindle 21 can be determined. The mentioned sensors transmit their measurement signals as described to the control device 5, so that the synchronization of all lifting columns there is monitored and, if necessary, action is taken on a lifting column not running in synchronization or the operation of the entire lifting device is blocked when a predetermined lifting difference is exceeded.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A method for controlling a vehicle lifting device having at least two, preferably moveable, lifting columns (1-4), which are controlled wirelessly, and a control device (5) for wirelessly monitoring signal transmissions, the method comprising activating a switch to cause raising and/or lowering movements of the lifting device, wirelessly transmitting to each of the lifting column(s) (1-4) a signal corresponding to the switch activation to cause corresponding raising or lowering movements of the individual lifting column(s), transmitting to the control device (5) additional signals, which are representative of the individual raising or lowering movements of each column, wherein the control device (5) continuously exchanges control signals with the lifting columns (1-4) and monitors reception of the control signals at least at one of the control device (5) and the lifting columns (1-4), and stopping normal operation of the raising or lowering movements for unacceptably high movement differences among the individual lifting columns, wherein the lifting movement in each lifting column (1-4) is transmitted via a rotating threaded spindle (21) and the threaded spindle (21) engages with a grip nut (22), which is set in rotation during raising and lowering movements, is led into active connection with a braking element (29), and is braked when a certain lowering speed of the threaded spindle is exceeded.

2. The method according to claim 1, wherein the exchange of control signals is performed at a frequency of at least 1 Hz.

3. The method according to claim 2, wherein the exchange of control signals is performed at a frequency of at least 3 Hz.

4. The method according to claim 2, wherein the exchange of control signals is performed at a frequency of at least 6 Hz.

5. The method according to claim 1, wherein the control device (5) stops the operation of the raising or lowering movements for an interfering signal exchange.

6. The method especially according to claim 1, wherein the control device (5) is arranged separate from the lifting columns (1-4).

7. The method according to claim 1, wherein the lifting device is activated by switches, attached to the lifting columns (1-4), and when activated, the switches generate signals that are transmitted wirelessly to the control device (5) and from the control device wirelessly to all of the lifting columns.

8. The method according to claim 1, wherein the lifting columns (1-4) are equipped with measurement elements for determining an individual lifting position of the lifting columns, respectively, the individual lifting positions of the lifting columns are transmitted continuously and wirelessly to the control device (5), and, if necessary, the control device transmits control signals to the respective lifting columns to synchronize and/or stop the operation of the lifting columns for unacceptably large lifting differences.

9. The method according to claim 1, wherein the lifting columns (1-4) are equipped with measurement elements for determining an individual lifting position of the lifting columns, respectively, the individual lifting positions of the lifting columns are transmitted continuously and wirelessly to regulating devices arranged on the respective lifting column (1-4), setting a desired value by one of the regulating devices, and, if necessary, the one regulating device acts on its lifting column and/or on the other lifting columns to achieve the desired value.

10. The method according to claim 1, wherein each lifting column (1-4) is combined with an anti-drop device.

11. The method according to claim 1, wherein the grip nut (22) is in active connection with an incremental path measurement system (30) on its periphery.

12. The method according to claim 1, wherein each lifting column (1-4) is equipped with a separate energy accumulator, in particular a rechargeable battery (1*a*), and a motor (1*b*) for generating a raising or lowering movement.

13. The method according to claim 1, wherein each lifting column (1-4) is equipped with a wheel fork (14) for engaging a vehicle wheel from below.

* * * * *